US005529260A

United States Patent [19]

Wirick

[11] Patent Number: 5,529,260

[45] Date of Patent: Jun. 25, 1996

[54] RAIL ENGAGING TOILET PAPER HOLDER

[76] Inventor: Carol D. Wirick, P.O. Box 944, Lake Placid, Fla. 33852

[21] Appl. No.: 352,914

[22] Filed: Dec. 9, 1994

[51] Int. Cl.[6] ..... B65H 16/06

[52] U.S. Cl. ..... 242/596.800; 4/300.100

[58] Field of Search ..... 4/300.1; 242/596, 242/596.3, 596.7, 596.8, 598.5

[56] References Cited

U.S. PATENT DOCUMENTS

| | | | |
|---|---|---|---|
| D. 318,770 | 8/1991 | Grisel | D6/523 |
| 1,217,147 | 2/1917 | Burwell | 4/559 X |
| 2,244,804 | 6/1941 | Robinson | 242/598.5 |
| 2,790,608 | 4/1957 | Sieven | 242/596.8 X |
| 4,513,923 | 4/1985 | Olics | 242/598.5 |
| 4,858,840 | 8/1989 | Kidman | 242/596.3 |

*Primary Examiner*—Charles E. Phillips

[57] ABSTRACT

A holder for rotatably supporting a roll of toilet paper relative to a rail of a supporting structure. The inventive device includes a mounting assembly which can be snapped over a cylindrical rail of a wheelchair or portable toilet structure. A supporting assembly extends from the mounting assembly for engaging and rotatably supporting a roll of toilet paper relative to the supporting structure.

4 Claims, 4 Drawing Sheets

FIG 3
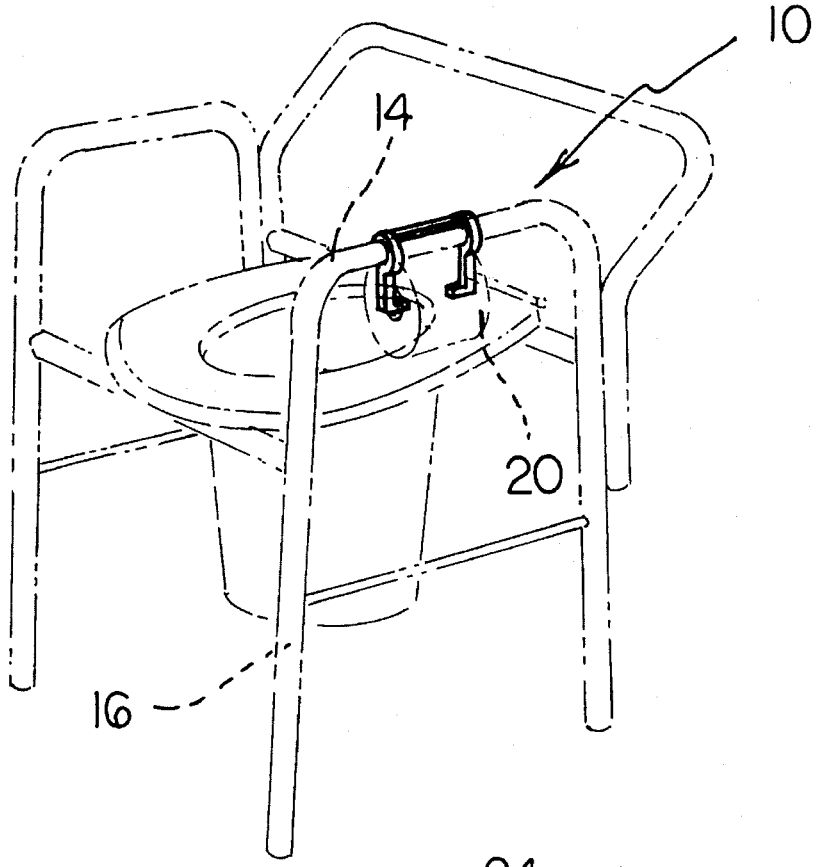
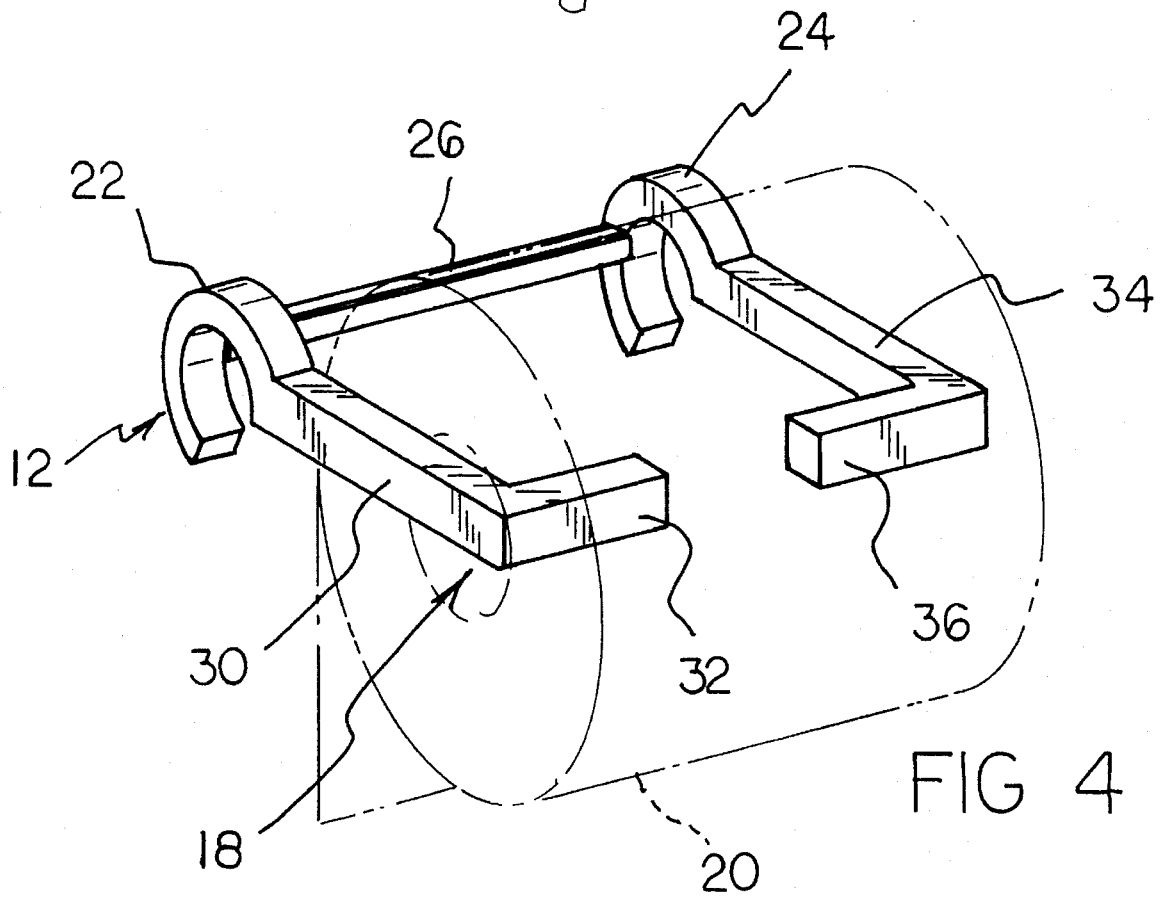
FIG 4

FIG 5
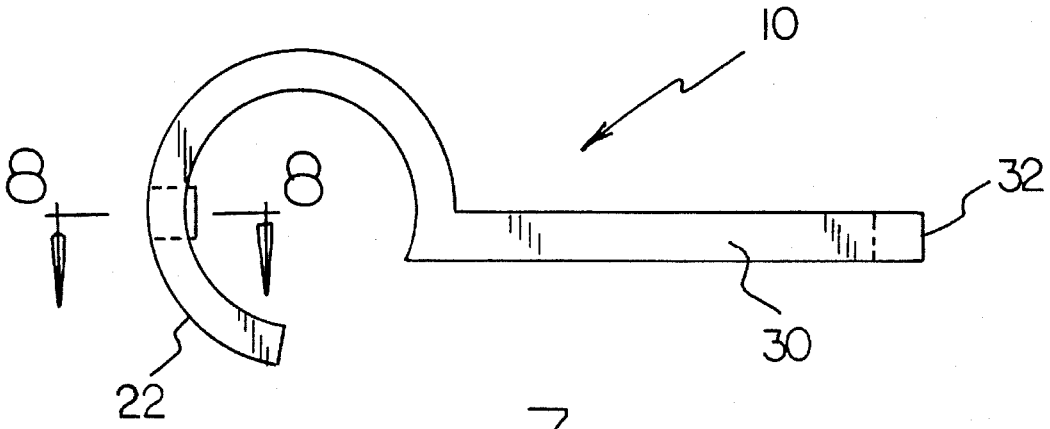
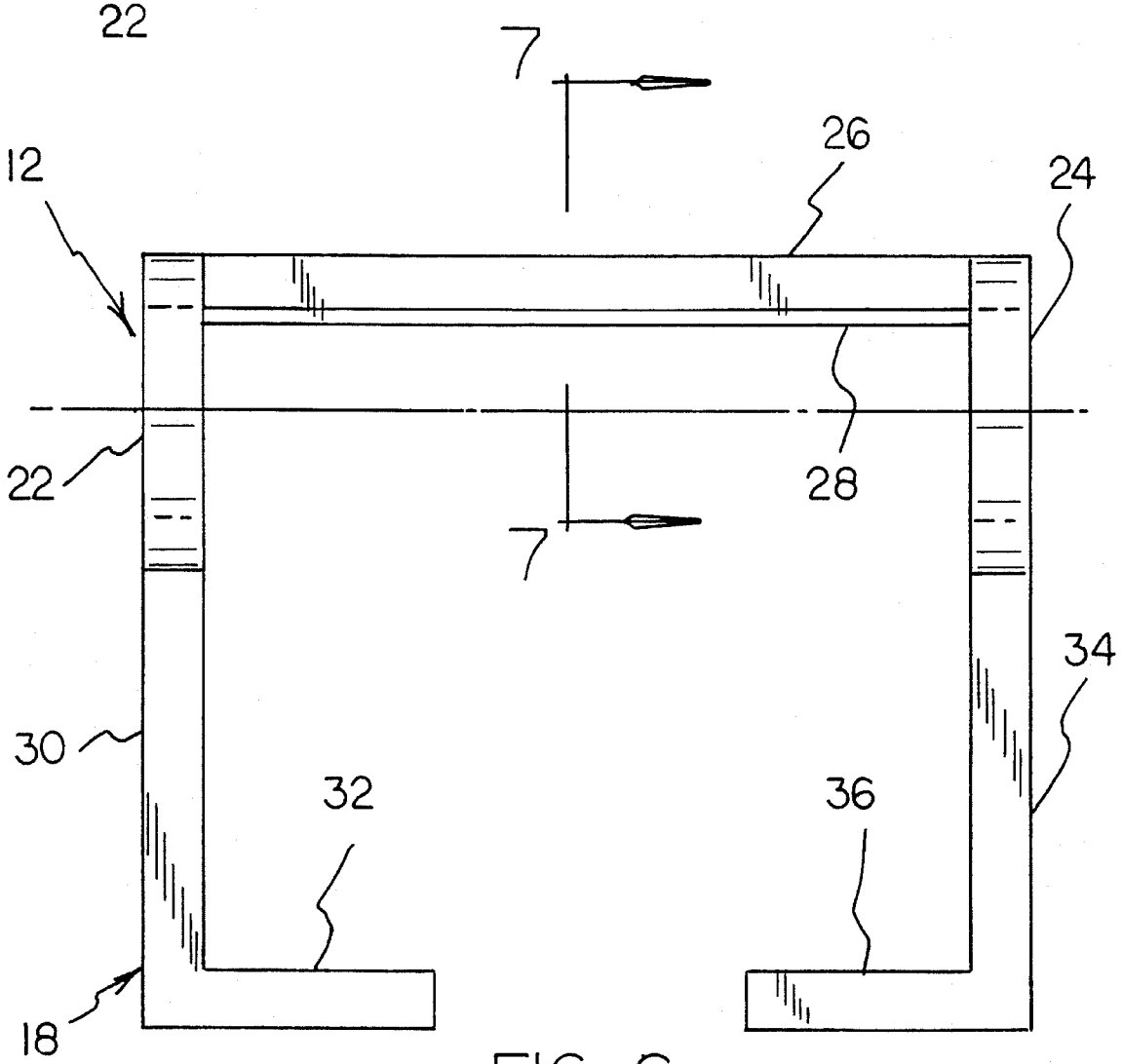
FIG 6

RAIL ENGAGING TOILET PAPER HOLDER

BACKGROUND OF THE INVENTION

1. Field of the Invention

The present invention relates to roll holders and more particularly pertains to a rail engaging toilet paper holder for rotatably supporting a roll of toilet paper relative to a rail of a supporting structure.

2. Description of the Prior Art

The use of roll holders is known in the prior art. More specifically, roll holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art roll holders include U.S. Pat. Nos. 4,513,932; 4,218,028; 4,106,617; 3,792,822; and U.S. Pat. No. 3,482,796.

While these devices fulfill their respective, particular objectives and requirements, the aforementioned patents do not disclose a rail engaging toilet paper holder for rotatably supporting a roll of toilet paper relative to a rail of a supporting structure which includes a mounting assembly that can be snapped over a cylindrical rail of the supporting structure, and a supporting assembly extending from the mounting assembly for engaging and rotatably supporting a roll of toilet paper.

In these respects, the rail engaging toilet paper holder according to the present invention substantially departs from the conventional concepts and designs of the prior art, and in so doing provides an apparatus primarily developed for the purpose of rotatably supporting a roll of toilet paper.

SUMMARY OF THE INVENTION

In view of the foregoing disadvantages inherent in the known types of roll holders now present in the prior art, the present invention provides a new rail engaging toilet paper holder construction wherein the same can be utilized for rotatably supporting a roll of toilet paper. As such, the general purpose of the present invention, which will be described subsequently in greater detail, is to provide a new rail engaging toilet paper holder apparatus and method which has many of the advantages of the roll holders mentioned heretofore and many novel features that result in a rail engaging toilet paper holder which is not anticipated, rendered obvious, suggested, or even implied by any of the prior art roll holders, either alone or in any combination thereof.

To attain this, the present invention generally comprises a holder for rotatably supporting a roll of toilet paper relative to a rail of a supporting structure. The inventive device includes a mounting assembly which can be snapped over a cylindrical rail of a wheelchair or portable toilet structure. A supporting assembly extends from the mounting assembly for engaging and rotatably supporting a roll of toilet paper relative to the supporting structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rail engaging toilet paper holder apparatus and method which has many of the advantages of the roll holders mentioned heretofore and many novel features that result in a rail engaging toilet paper holder which is not anticipated, rendered obvious, suggested, or even implied by any of the prior art roll holders, either alone or in any combination thereof.

It is another object of the present invention to provide a new rail engaging toilet paper holder which may be easily and efficiently manufactured and marketed.

It is a further object of the present invention to provide a new rail engaging toilet paper holder which is of a durable and reliable construction.

An even further object of the present invention is to provide a new rail engaging toilet paper holder which is susceptible of a low cost of manufacture with regard to both materials and labor, and which accordingly is then susceptible of low prices of sale to the consuming public, thereby making such rail engaging toilet paper holders economically available to the buying public.

Still yet another object of the present invention is to provide a new rail engaging toilet paper holder which provides in the apparatuses and methods of the prior art some of the advantages thereof, while simultaneously overcoming some of the disadvantages normally associated therewith.

Still another object of the present invention is to provide a new rail engaging toilet paper holder for rotatably supporting a roll of toilet paper relative to a rail of a supporting structure.

Yet another object of the present invention is to provide a new rail engaging toilet paper holder which includes a mounting assembly that can be snapped over a cylindrical rail of the supporting structure, and a supporting assembly extending from the mounting assembly for engaging and rotatably supporting a roll of toilet paper.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of rail engaging toilet paper holder according to the present invention in use.

FIG. 4 is an isometric illustration of the present invention engaged to a toilet paper roll.

FIG. 5 is a side elevation view of the invention.

FIG. 6 is a top plan view thereof.

DESCRIPTION OF THE PREFERRED EMBODIMENT

Figure 1:
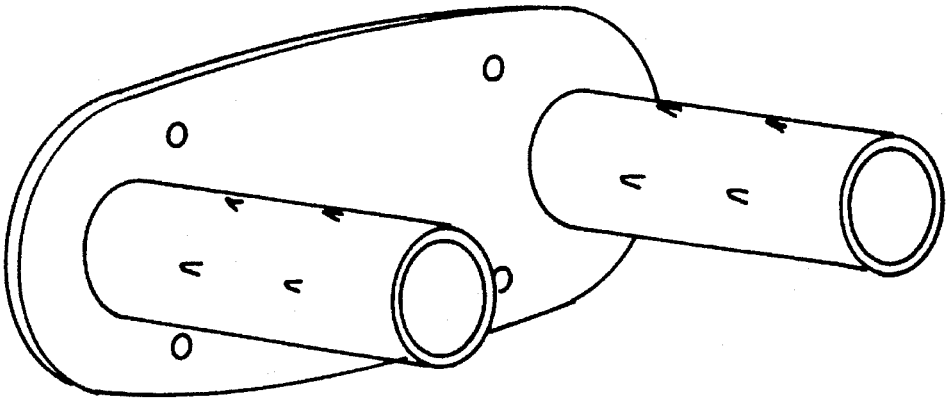
FIG 1 PRIOR ART
FIG. 1 is an isometric illustration of a prior art roll holder.

With reference now to the drawings, and in particular to FIGS. 3–8 thereof, a new rail engaging toilet paper holder embodying the principles and concepts of the present invention and generally designated by the reference numeral 10 will be described.

Figure 2:
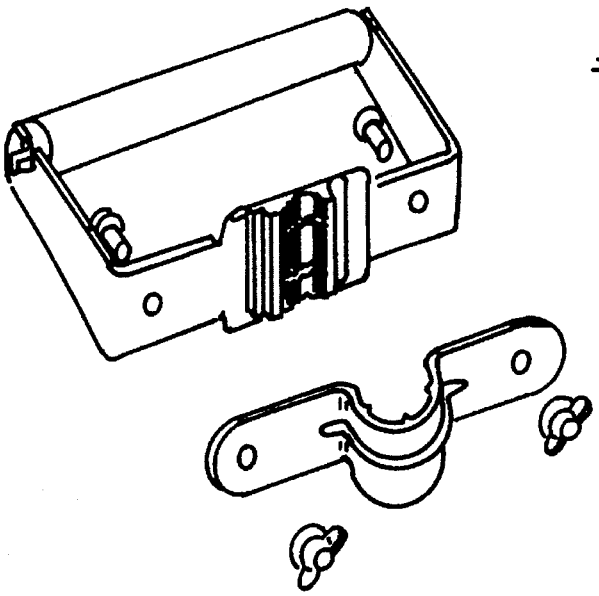
FIG 2 PRIOR ART
FIG. 2 is an exploded isometric illustration of a further prior art roll holder.

Turning initially to FIGS. 1 and 2 wherein prior art roll holders are illustrated, it can be shown that the prior art teaches a roll holder securable to a flat wall surface, as shown in FIG. 1, or a roll holder having a complicated clamp structure for securing the roll holder to an elongated member, as shown in FIG. 2.

Turning now to FIGS. 3 through 8 wherein the rail engaging toilet paper 10 according to present invention is illustrated in detail, it can be shown that the toilet paper holder substantially departs from the designs and concepts of the prior art and includes a mounting means 12 for engaging a rail 14 of a supporting structure 16, such as the portable toilet structure illustrated in FIG. 3 of the drawings. A supporting means 18 is coupled to the mounting means 12 and extends outwardly therefrom to rotatably support a toilet paper roll 20 as shown in FIG. 4 for example. Thus, the present invention 10 can be utilized to rotatably mount the toilet paper roll 20 relative to a supporting structure 16 such as a portable toilet or wheelchair.

Figure 7:
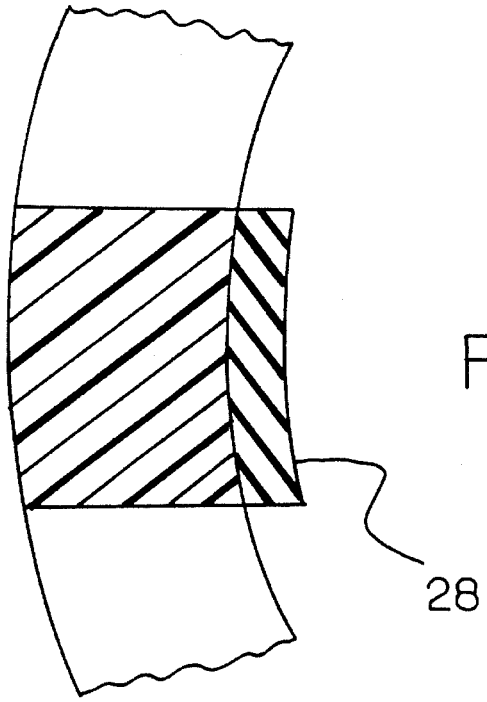
FIG. 7 is a cross sectional view taken along line 7—7 of FIG. 6.
Figure 8:
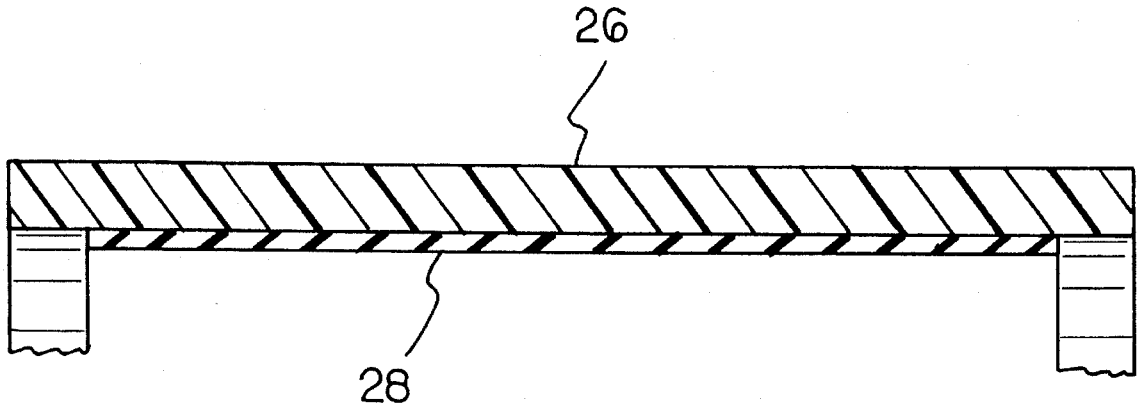
FIG. 8 is a cross sectional taken along line 8—8 of FIG. 5.

As best illustrated in FIGS. 4 through 6, it can be shown that the mounting means 12 according to the present invention 10 preferably comprises a first mounting loop 22 of arcuate configuration spaced from a second mounting loop 24 of similar construction. A transverse leg 26 extends between the mounting loops 22 and 24 to maintain the mounting loops in a spaced and parallel orientation. The mounting loops 22 and 24 are operable to be snapped into engagement with the rail 14 of the supporting structure 16 to secure the mounting means 12 thereto. Preferably, and as shown in FIGS. 7 and 8, the mounting means 12 additionally comprises means for providing friction in the form of a friction strip 28 extending along an interior surface of the transverse leg 26. The friction strip 28 is preferably comprised of a substantially resilient material so as to promote frictional engagement between the friction strip 28 and the rail 14 to preclude a rotation of the mounting means 12 relative to the rail.

As shown in FIGS. 4 and 6, the supporting means 18 according to the present invention 10 extends from the mounting means 12 so as to project laterally from the supporting structure 16 to which the mounting means is attached. The supporting means 18 preferably comprises a first projecting leg 30 secured to the first mounting loop 22 and terminating at an outer distal end thereof. A first supporting leg 32 is coupled to the outer distal end of the first projecting leg 30 and oriented so as to extend substantially orthogonally therefrom. Similarly, a second projecting leg 34 is fixedly secured to the mounting loop 24 and extends outwardly therefrom to terminate in an outer distal end, with a second supporting leg 36 being coupled to the outer distal end of the second projecting leg 34 and oriented so as to extend substantially orthogonally therefrom. The first and second supporting legs 32 and 36 are oriented so as to project towards one another, as shown in FIG. 4, such that they can be extended into an interior of a toilet paper roll 20 positioned between the projecting legs 30 and 34.

The mounting means 12 and the supporting means 18 are preferably integrally molded from a resilient plastic material or the like which permits an outward biasing of the projecting legs 30 and 34 to facilitate placement of the toilet paper roll 20 therebetween. Further, constructing the mounting means 12 of the resilient plastic material permits a deformation of the mounting loops 22 and 24 during engagement thereto relative to the rail 14 of the supporting structure 16, whereby the resilient nature of the plastic material results in a contraction of the mounting loops subsequent to placement over the rail 14 which further enhances securement of the mounting means 12 to the rail.

In use, the rail engaging toilet paper holder according to the present invention can be easily engaged to the rail 14 of a supporting structure 16 so as to rotatably support a toilet paper roll 20 relative to an individual. The supporting structure 16 may comprise a wheelchair or a portable toilet, for example.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A rail engaging toilet paper holder comprising:

a mounting means having an arcuate first mounting loop spaced from an arcuate second mounting loop; and a transverse leg having an exterior and an interior surface thereon, said leg extending between the mounting loops to maintain the mounting loops in a spaced and parallel orientation, the mounting loops being operable to be snapped into engagement with a rail of a supporting structure to secure the mounting means thereto, said interior surface having means for providing friction in engagement with said rail when said loops are snapped into engagement with said rail; and a supporting means coupled to the mounting means and extending outwardly therefrom to rotatably support a toilet paper roll.

2. The rail engaging toilet paper holder of claim 1, wherein the mounting means further comprises a friction strip extending along an interior surface of the transverse leg, the friction strip being comprised of a substantially resilient material so as to promote frictional engagement between the friction strip and a rail to preclude a rotation of the mounting means relative to the rail.

3. The rail engaging toilet paper holder of claim 2, wherein the supporting means comprises a first projecting leg secured to the first mounting loop and extending outwardly therefrom to terminate at an outer distal end; a first supporting leg coupled to the outer distal end of the first projecting leg and oriented so as to extend substantially orthogonally therefrom; a second projecting leg fixedly secured to the mounting loop and extending outwardly therefrom to terminate in an outer distal end; and a second supporting leg coupled to the outer distal end of the second projecting leg and oriented so as to extends substantially orthogonally therefrom, the first and second supporting legs being oriented so as to project towards one another such that they can be extended into an interior of a toilet paper roll positioned between the projecting legs.

4. The rail engaging toilet paper holder of claim 3, wherein the mounting means and the supporting means are integrally molded from a resilient plastic material which permits an outward biasing of the projecting legs to facilitate placement of a toilet paper roll therebetween.

* * * * *